United States Patent [19]

Brown

[11] Patent Number: 4,607,986

[45] Date of Patent: Aug. 26, 1986

[54] SHIELD SUPPORTS SUITABLE FOR USE IN MINES

[75] Inventor: Stephen A. Brown, Cheltenham, England

[73] Assignee: Dowty Mining Equipment Limited, Tewkesbury, England

[21] Appl. No.: 632,542

[22] Filed: Jul. 19, 1984

[30] Foreign Application Priority Data

Jul. 23, 1983 [GB] United Kingdom ..... 8319887

[51] Int. Cl.[4] ..... E21D 17/02; E21D 19/00

[52] U.S. Cl. ..... 405/296; 405/295

[58] Field of Search ..... 405/291–297, 405/299; 299/31, 33

[56] References Cited

U.S. PATENT DOCUMENTS

| | | | |
|---|---|---|---|
| 3,885,396 | 5/1975 | Snowden et al. | 405/291 |
| 3,928,981 | 12/1975 | Parker et al. | 405/293 |
| 4,037,419 | 7/1977 | Hill et al. | 405/296 X |
| 4,048,804 | 9/1977 | Elsner et al. | 405/296 X |
| 4,197,035 | 4/1980 | Siebenhofer et al. | 405/296 |

FOREIGN PATENT DOCUMENTS

| | | | |
|---|---|---|---|
| 2630815 | 2/1977 | Fed. Rep. of Germany | 405/295 |
| 1415244 | 11/1975 | United Kingdom . | |
| 1533981 | 11/1978 | United Kingdom . | |
| 1579574 | 11/1980 | United Kingdom . | |
| 1601358 | 10/1981 | United Kingdom | 405/296 |
| 2115046A | 1/1982 | United Kingdom . | |

*Primary Examiner*—Cornelius J. Husar
*Assistant Examiner*—Nancy J. Stodola
*Attorney, Agent, or Firm*—Hayes, Davis & Soloway

[57] ABSTRACT

A shield support, suitable for use in mines, comprising a floor-engaging structure which includes two sledge or like elements disposed side-by-side and spaced apart one from the other, a roof-engageable canopy, a shield mounted for pivotal movement with respect to the canopy and extendable and contractible prop means, carried by said elements, which are operable to adjust the height of the canopy. A pivotal guide linkage for supporting the shield from said elements includes links which are so connected to those elements and to the shield that the elements are rigidly coupled together only through the intermediary of those links and the shield.

7 Claims, 5 Drawing Figures

SHIELD SUPPORTS SUITABLE FOR USE IN MINES

This invention relates to shield supports suitable for use in mines for supporting the mine roof during mineral-mining operations.

Such shield supports can be of self-advancing type and include a rigid floor-engaging structure provided with advancing means, extendable and contractible prop means carried by said structure, a roof-engageable canopy raisable by said prop means, and a shield which is supported from said structure by pivotal guide means, for example a so-called "lemniscate linkage", said shield being also pivotally-connected to the canopy at or near its rearward end portion, that is the end portion of the canopy remote from the mineral face being worked.

The floor-engaging structure in many cases comprises a solid platten. Alternatively it may comprise two sledge or like elements arranged side-by-side and spaced apart one from the other. In order to provide the structure with its rigidity these elements are joined at or near their forward ends and at or near their rearward ends by respective bridge members capable of resisting torsion loads which, during mineral-mining operations, may be applied to the structure. In certain supports the sledge or like elements are joined by a bridge member only at or near their forward ends and in this case a torsion-resistant rear link replaces the rearward bridge member to resist relative movement of the elements under load.

Disadvantages of the solid platten, and also of the sledge or like elements joined together by forward and rearward bridge members, and the relatively high cost, weight and size thereof, and whilst some reduction in cost, weight and size is achieved by the use of a torsion-resistant rear link fitted to the sledge or like elements, nevertheless further such reduction is desirable.

The invention as claimed is intended to provide a remedy. It solves the problem of how to design an improved shield support in which two sledge or like elements are so coupled as to form a floor-engaging structure having the stiffness of a single rigid member without incurring substantial cost, weight and size.

According to this invention a shield support, suitable for use in mines, comprises a floor-engaging structure which includes two sledge or like elements disposed side-by-side and spaced apart one from the other, a roof-engageable canopy, a shield mounted for pivotal movement with respect to the canopy, extendable and contractible prop means carried by said sledge or like elements and operable to adjust the height of said canopy, and a pivotal guide linkage for supporting said shield from said elements, said linkage including links which are so connected to said elements and to said shield that said elements are rigidly coupled together only through the intermediary of those links and said shield.

Preferably said linkage comprises three links, one of these links, that is an upper link, being at one end pivotally-connected to said shield and at its other end being journalled to each of the two sledge or like elements at a position intermediate the length thereof. The other two links, that is lower links, are in this case each pivotally-connected between the end portion of a respective said element remote from the mineral face being worked and a respective underside portion of said shield.

Alternatively with a three-link linkage two of the links may form upper links, being mounted side-by-side, being pivotally-connected each at one end to said shield and being journalled each at the other end to a respective sledge or like element intermediate its length. In this case the third link may form a lower link of substantial cross-section which is pivotally-connected between the shield and the sledge or like elements to form a torsion-resistant member. The lower link may comprise two identical links secured together side-by-side.

The advantages offered by the invention are mainly that torsional forces transmitted to the links of said linkage are in turn passed into, and absorbed by, the structure of the shield.

One way of carrying out the invention is described in detail below with reference to drawings which illustrate only one specific embodiment, in which.

Figure 1:
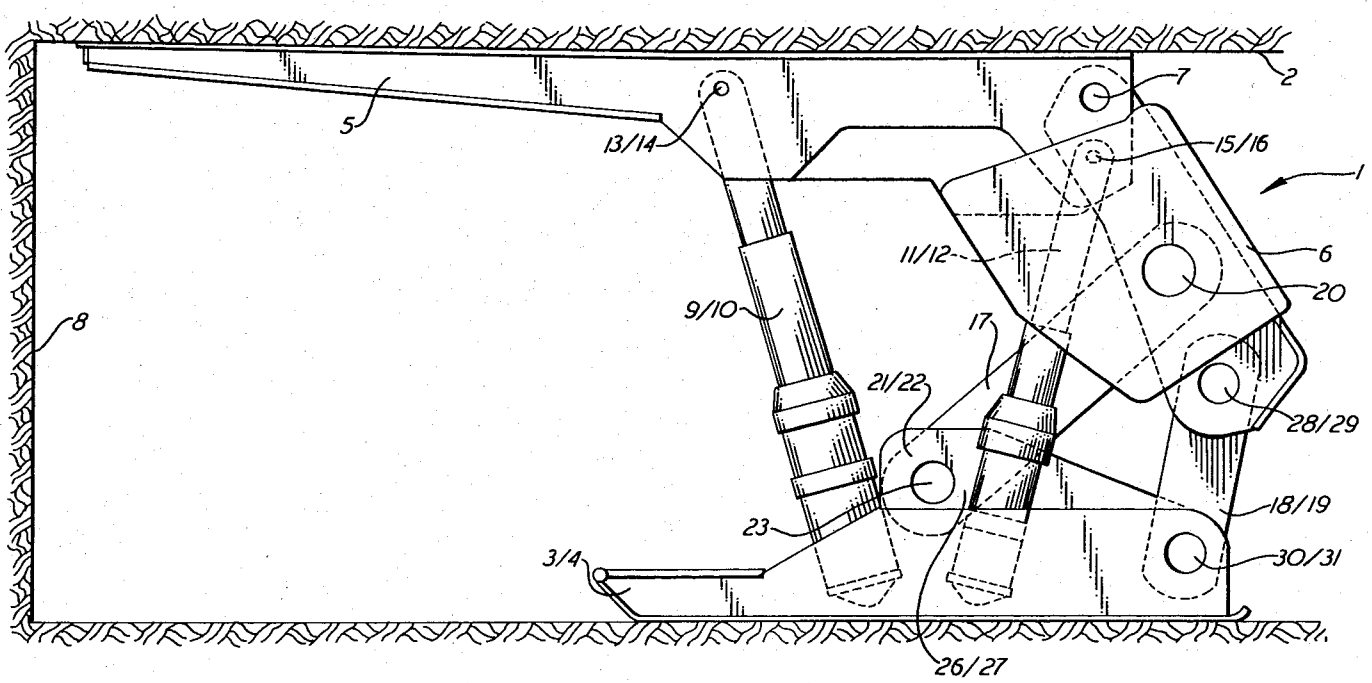
FIG. 1 is a side elevation of a shield support in accordance with the invention.

In the drawings a shield support 1 for use in a mine for supporting the mine roof 2 during mineral-mining operations includes a mine-floor-engaging structure in the form of two sledge elements 3, 4 disposed side-by-side and spaced apart one from the other, a roof-engageable canopy 5, and a goaf shield 6 pivotally-connected at 7 to the canopy at its end portion remote from the mineral face 8 being worked. Prop means comprising four hydraulically-extendable and contractible props 9, 10, 11, 12 are carried by the floor-engaging structure in the manner shown, the forward props 9, 10 being pivotally-connected to the underside of the canopy at 13, 14 and the rearward props 11, 12 being pivotally-connected at 15, 16 to the underside of shield 6. Thus the four props act between sledge elements 3, 4 and the canopy and shield, and when extended the props urge the canopy into engagement with roof 2.

The shield support also includes a pivotal guide linkage for supporting shield 6 from sledge elements 3, 4, this linkage comprising three links 17, 18, 19. The first or upper link 17 is at one end pivotally-connected at 20 to the underside of the shield and at its other end is journalled at 21 and 22 respectively to each sledge element 3, 4 at a position intermediate its length. To this end a single pivot pin 23 passing through link 17 extends through bearings 24, 25 carried by upstanding flanges 26, 27 respectively projecting from sledge elements 3, 4.

The second and third or lower links 18, 19 are each at one end pivotally-connected at 28, 29 to the underside of shield 6, while at its other end each is pivotally-connected at 30, 31 to the end portion of a respective sledge element 3, 4 remote from face 8. In this way the sledge elements are rigidly coupled together through the intermediary of links 17, 18, 19 and shield 6.

Thus the links themselves provide the only means of coupling the two sledge elements together so that they perform as if they were a single rigid member.

The rigid floor-engaging structure is required during mineral-mining operations to cater for many different loading conditions. The greatest loads tending to cause relative displacement of the two sledge elements are of two forms. The first form arises from torsion between the sledge elements about an axis parallel with the axis of bearings 24, 25, and the second arises from torsion about an axis which runs parallel to the length of each sledge element. In the above arrangement the upper link 17 is constructed so that when assembled with the sledge elements, the axis of bearings 24, 25 becomes a common axis for relative rotation between those elements. The other links 18, 19, when assembled between the sledge elements and the shield, resist torsion developed between the sledge elements. Further, at least one of the links is capable, by virtue of its cross-section, of resisting the torsion generated along each sledge element.

Figure 2:
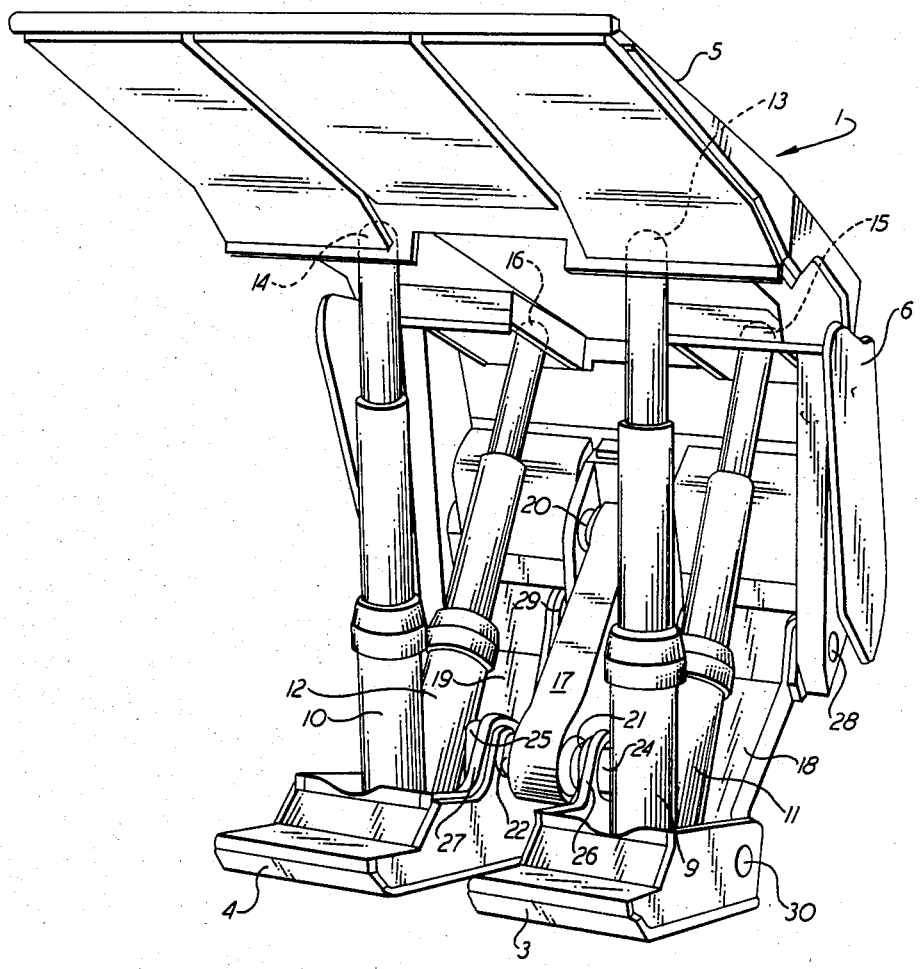
FIG. 2 is a perspective view of the shield support shown in FIG. 1.
Figure 3:
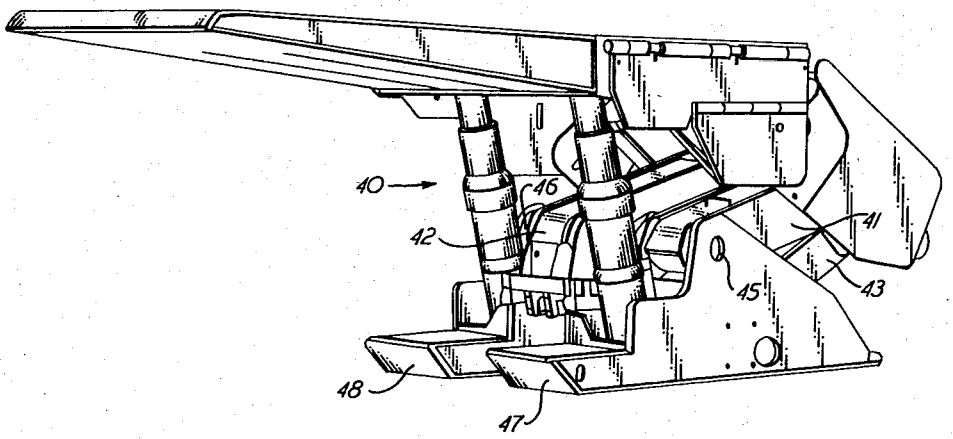
FIG. 3 is a perspective side view of the shield support showing an alternative embodiment with two upper links and one lower link.
Figure 5:
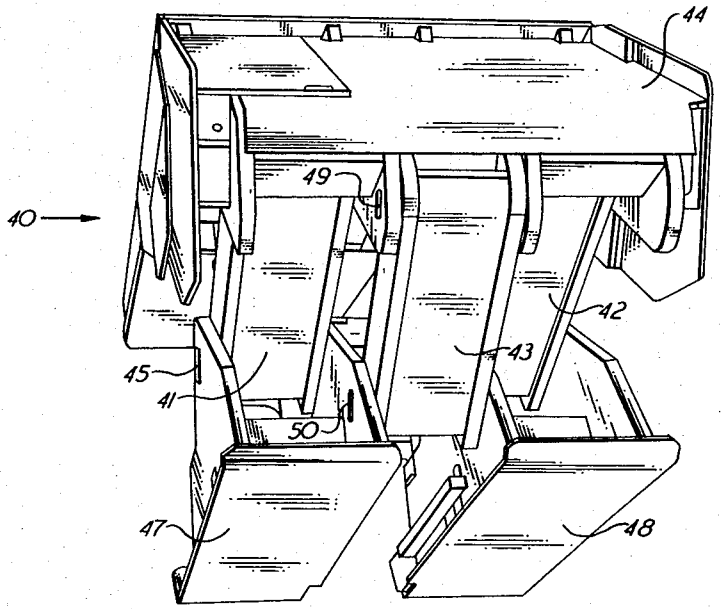
FIG. 5 is a perspective bottom view of the embodiment shown in FIG. 3.
Figure 4:
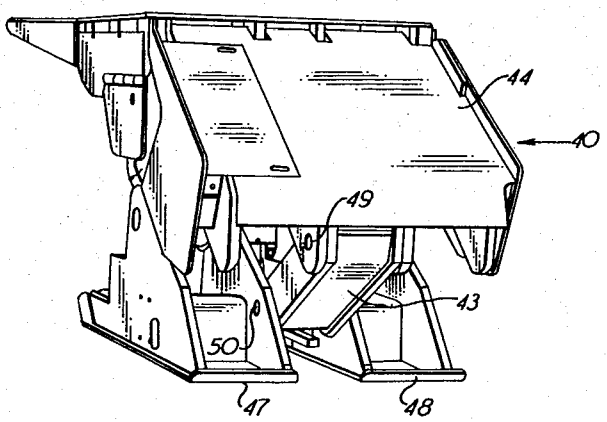
FIG. 4 is a perspective back view of the embodiment shown in FIG. 3.

With reference to FIGS. 3, 4 and 5, in an alternative embodiment of the invention the shield support 40 is basically similar to that above described with reference to FIGS. 1 and 2, but two of the three links 41, 42, 43 of the pivotal guide linkage form upper links. These upper links 41, 42 are mounted side-by-side and are pivotally-connected each at one end to the shield 44. At its other end each of these links 41, 42 is journalled at 45, 46 to a respective sledge element 47, 48 at a position intermediate the length of that element. In this case the third link 43 forms a lower link of substantial cross-section which is pivotally-connected at 49, 50 between the shield 44 and both sledge elements 47, 48 in the manner shown to form a torsion-resistant member. The lower link 43 may comprise two identical links secured side-by-side.

Although in the embodiment above described with reference to the drawings the pivotal guide linkage comprises three links, in alternative embodiments of the invention the pivotal guide linkage may comprise any other suitable and practical number of links.

In all embodiments of the invention the torsional forces transmitted to the links during mineral-mining operations are in turn passed into, and absorbed by, the structure of the shield. By each of these constructions there is no need to provide one or more members so welded directly to, or so otherwise directly fast with, both sledge elements as to form a rigid bridge or bridges joining those elements near their forward and/or their rearward ends.

I claim:

1. A shield support, suitable for use in mines, which comprises a floor-engaging structure including two sledge elements which are disposed side-by-side and which are spaced apart one from the other, a roof-engageable canopy, a shield mounted for pivotal movement with respect to the canopy, extendable and contractible prop means carried by said sledge elements and operable to adjust the height of said canopy, and a pivotal guide linkage for supporting said shield from said sledge elements and for providing in conjunction with the shield a torsion-resistant connection between those otherwise independent said sledge elements, said linkage including three links, each of which is at one end pivotally-connected to said shield, one of said links being at its other end pivotally-connected to one of said sledge elements, another of said links being at its other end pivotally-connected to the other of said sledge elements, and the third of said links being of substantial cross-section and being at its other end directly pivotally-connected to both said sledge elements, the connection of said third of said links to both said sledge elements forming the only means directly joining those elements together.

2. A support as claimed in claim 1, wherein one of said three links forms an upper link of substantial cross-section, that link being at one end pivotally-connected to said shield, being at its other end journalled to each of the two sledge elements and forming a torsion-resistant member.

3. A support as claimed in claim 2, wherein a single pivot pin passes through said other end of said one link, said pin extending through bearings carried by upstanding flanges respectively projecting from said sledge elements.

4. A support as claimed in claim 2, wherein the other two links, which form lower links, are each pivotally-connected between the end portion of a respective said element remote from the mineral face being worked and a respective underside portion of said shield.

5. A support as claimed in claim 1, wherein two of said three links form upper links, said two links being mounted side-by-side, being pivotally-connected each at one end to said shield and being journalled each at the other end to a respective sledge element at a position intermediate the length thereof.

6. A support as claimed in claim 5, wherein the third of said links forms a lower link of substantial cross-section which is pivotally-connected between the shield and the sledge elements to form a torsion-resistant member.

7. A support as claimed in claim 6, wherein said lower link comprises two identical links secured together side-by-side.

* * * * *